US005817371A

United States Patent [19]

Gupta et al.

[11] Patent Number: 5,817,371

[45] Date of Patent: Oct. 6, 1998

[54] THERMAL BARRIER COATING SYSTEM HAVING AN AIR PLASMA SPRAYED BOND COAT INCORPORATING A METAL DIFFUSION, AND METHOD THEREFOR

[75] Inventors: Bhupendra K. Gupta, Cincinnati; Thomas E. Mantkowski, Madeira, both of Ohio

[73] Assignee: General Electric Company, Cincinnati, Ohio

[21] Appl. No.: 975,972

[22] Filed: Nov. 21, 1997

Related U.S. Application Data

[63] Continuation of Ser. No. 777,955, Dec. 23, 1996, abandoned.

[51] Int. Cl.[6] ..... C23C 4/06; C23C 4/12; C23C 4/18

[52] U.S. Cl. ..... 427/454; 427/455; 427/456; 427/383.7

[58] Field of Search ..... 427/454, 383.7, 427/455, 456

[56] References Cited

U.S. PATENT DOCUMENTS

| | | | |
|---|---|---|---|
| 3,890,456 | 6/1975 | Dils | 428/216 |
| 4,055,705 | 10/1977 | Stecura et al. | 428/633 |
| 4,123,594 | 10/1978 | Chang | 428/651 |
| 4,123,595 | 10/1978 | Chang | 428/667 |
| 4,248,940 | 2/1981 | Goward et al. | 428/633 |
| 4,328,285 | 5/1982 | Siemers et al. | 428/633 |
| 4,399,199 | 8/1983 | McGill et al. | 428/633 |
| 4,477,538 | 10/1984 | Clarke | 428/656 |
| 4,530,885 | 7/1985 | Restall | 428/670 |
| 4,535,033 | 8/1985 | Stecura | 428/633 |
| 4,851,300 | 7/1989 | Przybyszewski | 428/623 |
| 4,861,618 | 8/1989 | Vine et al. | 427/34 |
| 4,962,005 | 10/1990 | Alperine et al. | 428/670 |
| 5,238,752 | 8/1993 | Duderstadt et al. | 428/623 |
| 5,419,971 | 5/1995 | Skelly et al. | 428/612 |
| 5,427,866 | 6/1995 | Nagaraj et al. | 428/610 |
| 5,498,484 | 3/1996 | Duderstadt | 428/633 |
| 5,500,252 | 3/1996 | Meelu | 427/376.3 |

OTHER PUBLICATIONS

Thermal Spraying; Practice, Theory, and Application, American Welding Society, Inc., 1985, p. 42. (no month date).

*Primary Examiner*—Katherine A. Bareford

*Attorney, Agent, or Firm*—Andrew C. Hess; Nathan D. Herkamp

[57] ABSTRACT

A thermal barrier coating system and a method for forming the coating system on an article designed for use in a hostile thermal environment, such as superalloy turbine, combustor and augmentor components of a gas turbine engine. The method is particularly directed to a coating system comprising an APS bond coat on which a thermal-insulating APS ceramic layer is deposited, wherein the oxidation resistance of the bond coat and the spallation resistance of the ceramic layer are increased by diffusing platinum, palladium, hafnium, rhenium and/or rhodium into the bond coat. The diffusion process is performed so as not to alter the surface roughness of the bond coat, which is maintained in a range of about 200 to about 500 $\mu$inch Ra.

5 Claims, 1 Drawing Sheet

THERMAL BARRIER COATING SYSTEM HAVING AN AIR PLASMA SPRAYED BOND COAT INCORPORATING A METAL DIFFUSION, AND METHOD THEREFOR

This application is a Continuation of application Ser. No. 08/777,955 filed Dec. 23, 1996, now abandoned.

This invention relates to thermal barrier coating systems for components exposed to high temperatures, such as the hostile thermal environment of a gas turbine engine. More particularly, this invention is directed to a thermal barrier coating system having an air plasma-sprayed bond coat over which a thermal-insulating ceramic layer is deposited, wherein the bond coat incorporates a metal diffusion that promotes the oxidation resistance of the bond coat without altering the surface roughness of the bond coat.

BACKGROUND OF THE INVENTION

Higher operating temperatures for gas turbine engines are continuously sought in order to increase their efficiency. However, as operating temperatures increase, the high temperature durability of the components of the engine must correspondingly increase. Significant advances in high temperature capabilities have been achieved through the formulation of nickel and cobalt-base superalloys, and through the development of oxidation-resistant overlay coatings which are generally single-layer coatings or diffusions deposited directly on the surface of a superalloy substrate to form a protective oxide scale during high temperature exposure. Nonetheless, superalloys protected by overlay coatings often do not retain adequate mechanical properties for components located in certain sections of a gas turbine engine, such as the turbine, combustor and augmentor. A common solution is to thermally insulate such components in order to minimize their service temperatures. For this purpose, thermal barrier coatings (TBC) formed on the exposed surfaces of high temperature components have found wide use.

To be effective, thermal barrier coatings must have low thermal conductivity, strongly adhere to the article, and remain adherent throughout many heating and cooling cycles. The latter requirement is particularly demanding due to the different coefficients of thermal expansion between materials having low thermal conductivity and superalloy materials typically used to form turbine engine components. Thermal barrier coating systems capable of satisfying the above requirements have generally required a metallic bond coat deposited on the component surface, followed by an adherent ceramic layer that serves to thermally insulate the component.

Various ceramic materials have been employed as the ceramic layer, particularly zirconia ($ZrO_2$) stabilized by yttria ($Y_2O_3$), magnesia (MgO), ceria ($CeO_2$), scandia ($Sc_2O_3$), or another oxide. These particular materials are widely employed in the art because they can be readily deposited by plasma spray, flame spray and vapor deposition techniques. In order to increase the resistance of the ceramic layer to spallation when subjected to thermal cycling, thermal barrier coating systems employed in higher temperature regions of a gas turbine engine are typically deposited by physical vapor deposition (PVD) techniques, particularly electron beam physical vapor deposition (EBPVD), that yield a spall-resistant columnar grain structure in the ceramic layer.

The bond coat is typically formed from an oxidation-resistant aluminum-containing alloy to promote adhesion of the ceramic layer to the component and inhibit oxidation of the underlying superalloy. Examples of prior art bond coats include overlay coatings such as MCrAlY (where M is iron, cobalt and/or nickel), and diffusion coatings such as diffusion aluminide or platinum aluminide, which are oxidation-resistant aluminum-base intermetallics. The overlay bond coats are typically deposited by air plasma spray (APS), or by low pressure plasma spray (LPPS) techniques. The LPPS bond coats grow a strong adherent and continuous aluminum oxide layer (alumina scale) that chemically bonds the ceramic layer to the bond coat, and protects the bond coat and the underlying substrate from oxidation and hot corrosion.

In contrast, because APS bond coats are deposited at an elevated temperature in the presence of air, they inherently contain oxides and are more prone to oxidation because they do not grow a continuous oxide scale. As a result, APS bond coats do not have the high temperature (e.g., above 1000° C.) oxidation resistance of LPPS bond coats. Instead of the adhesion-promoting continuous oxide scale of the LPPS bond coats, adhesion of a ceramic layer to an APS bond coat is promoted by forming the bond coat to have a surface roughness of about 200 microinches (about 5 $\mu$m) to about 500 microinches (about 13 $\mu$m) Ra.

APS bond coats are often favored due to lower equipment cost and ease of application and masking. As a result, various approaches have been proposed to improve the oxidation resistance of APS bond coats, including overcoat aluminiding by which aluminum is diffused into the surface of the bond coat by pack cementation or non-contact vapor (gas phase) techniques. However, results tend to be inconsistent. In addition, while various overlay coating materials have been proposed to further enhance the oxidation resistance of diffusion aluminide and LPPS bond coats, e.g., U.S. Pat. No. 5,427,866 to Nagaraj et al., such techniques have not been appropriate for APS bond coats because the surface of the bond coat must remain sufficiently rough (about 200 to 500 $\mu$inch Ra) in order to suitably adhere the overlying ceramic layer.

Accordingly, what is needed is a process by which the oxidation resistance of an APS bond coat can be increased, yet without decreasing the surface roughness of the bond coat.

SUMMARY OF THE INVENTION

It is an object of this invention to provide an improved thermal barrier coating system and process for an article designed for use in a hostile thermal environment, such as superalloy components of a gas turbine engine.

It is another object of this invention that the coating system includes an APS bond coat and a thermal-insulating APS ceramic layer overlying the bond coat.

It is a further object of this invention that the bond coat includes a metal diffusion that improves the oxidation resistance of the bond coat without significantly altering its surface roughness.

It is yet another object of this invention that the metal diffusion serves to pin oxides at the bond coat-ceramic layer interface so as to promote adhesion of the ceramic layer to the bond coat.

The present invention generally provides a thermal barrier coating system and a method for forming the coating system on an article designed for use in a hostile thermal environment, such as superalloy turbine, combustor and augmentor components of a gas turbine engine. The method is particularly directed to a coating system that includes an APS MCrAlY bond coat on which a thermal-insulating APS ceramic layer is deposited, wherein the oxidation resistance of the bond coat and the spallation resistance of the ceramic layer are substantially increased.

According to this invention, the APS bond coat is deposited to have a surface roughness of about 200 to about 500 μinch Ra in order to promote the adhesion of the ceramic layer. As an APS bond coat, a continuous oxide layer is not present at the bond coat-to-ceramic layer interface. The oxidation resistance of the bond coat has been determined to be substantially improved, without altering the surface finish of the bond coat, by diffusing certain metals into the bond coat. Suitable metals for this purpose include platinum, palladium, hafnium, rhenium and rhodium. In a preferred embodiment, the metal is platinum that has been deposited as a thin layer on the bond coat, and then diffused through the bond coat and into the surface of the superalloy component on which the thermal barrier coating system is formed.

Thermal barrier coating systems formed in accordance with the above have been found to be capable of exhibiting enhanced spallation resistance, and therefore enable a longer service life of as much as two to four times that of conventional APS thermal barrier coating systems without the metal diffusion of this invention.

Other objects and advantages of this invention will be better appreciated from the following detailed description.

BRIEF DESCRIPTION OF THE DRAWINGS

The present invention will now be described, by way of example, with reference to the accompanying drawings, in which.

DETAILED DESCRIPTION OF THE INVENTION

Figure 1:
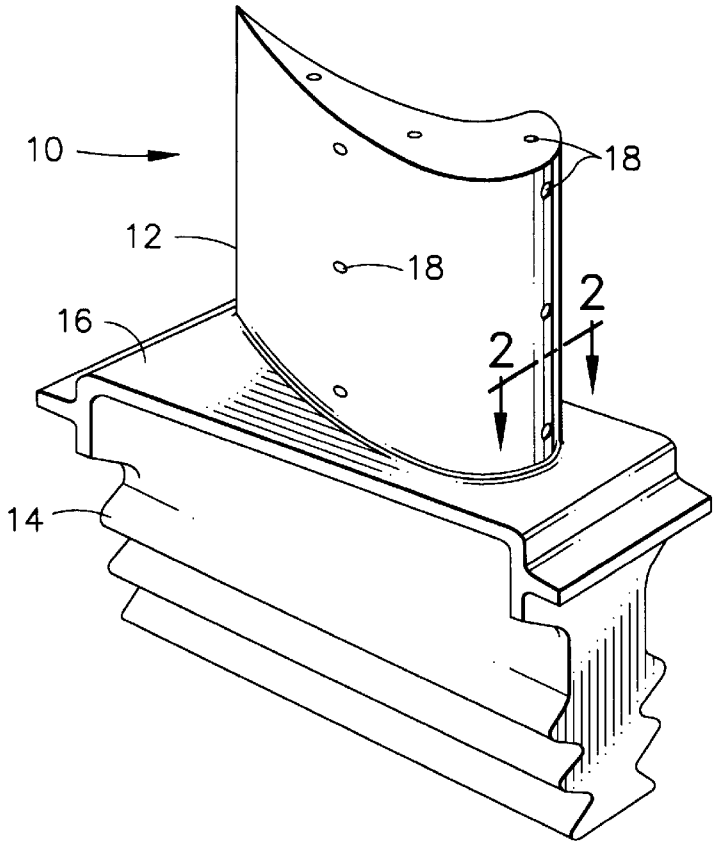
FIG. 1 is a perspective view of a high pressure turbine blade.

The present invention is generally applicable to components that operate within environments characterized by relatively high temperatures, and are therefore subjected to severe oxidation, thermal stresses and thermal cycling. Notable examples of such components include the high and low pressure turbine nozzles and blades, shrouds, combustor liners and augmentor hardware of gas turbine engines. An example of a high pressure turbine blade 10 is shown in FIG. 1. The blade 10 generally includes an airfoil 12 and platform 16 against which hot combustion gases are directed during operation of the gas turbine engine, and whose surfaces are therefore subjected to severe attack by oxidation, corrosion and erosion. The airfoil 12 is anchored to a turbine disk (not shown) with a dovetail 14 formed on a root section of the blade 10. Cooling passages 18 are present in the airfoil 12 through which bleed air is forced to transfer heat from the blade 10. While the advantages of this invention will be described with reference to the high pressure turbine blade 10 shown in FIG. 1, the teachings of this invention are generally applicable to any component on which an environmental coating may be used to protect the component from its environment.

Figure 2:
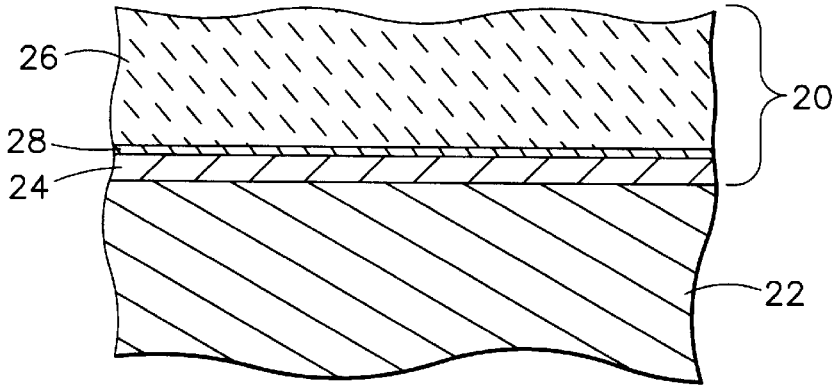
FIG. 2 is a cross-sectional view of the blade of FIG. 1 along line 2—2, and shows a thermal barrier coating on the blade in accordance with this invention.

Represented in FIG. 2 is a thermal barrier coating system 20 in accordance with this invention. As shown, the coating system 20 includes a thermally-insulating ceramic layer 26 on a bond coat 24 that overlies a substrate 22, the latter of which is typically the base material of the blade 10. Suitable materials for the substrate 22 (and therefore the blade 10) include nickel and cobalt-base superalloys. As is typical with thermal barrier coating systems for components of gas turbine engines, the bond coat 24 is an aluminum-rich material. According to this invention, the bond coat 24 is deposited by an APS technique, and is preferably APS MCrAlY, a metallic solid solution where M is iron, cobalt and/or nickel. Due to the APS deposition process, the bond coat 24 does not exhibit the same level of oxidation resistance as would an LPPS MCrAlY bond coat. In addition, the bond coat 24 is required to have a sufficiently rough surface, generally about 200 to about 500 μinch Ra, in order to tenaciously adhere the ceramic layer 26 to the substrate 22. The ceramic layer 26 is also deposited by APS techniques so as to be compatible with the APS bond coat 24. As such, the ceramic layer 26 does not have a strain-tolerant columnar grain structure, as is characteristic of ceramic deposited by physical vapor deposition techniques known in the art. A preferred material for the ceramic layer 26 is an yttria-stabilized zirconia (YSZ), a preferred composition being about 6 to about 8 weight percent yttria, though other ceramic materials could be used, such as yttria, nonstabilized zirconia, or zirconia stabilized by magnesia, ceria, scandia or another oxide. The ceramic layer 26 is deposited to a thickness that is sufficient to provide the required thermal protection for the underlying substrate 22 and blade 10, generally on the order of about 75 to about 300 micrometers.

An aluminum oxide scale (not shown) naturally develops on the bond coat 24 at elevated service and processing temperatures. The ceramic layer 26 is particularly prone to spallation once the oxide scale has reached a critical thickness on the surface of the bond coat 24, i.e., at the bond coat-ceramic layer interface. According to this invention, growth of this oxide scale is inhibited by the inclusion of a suitable metal diffusion 28 in the surface of the bond coat 24. The diffusion 28 improves the oxidation resistance of the bond coat by pegging or anchoring the oxides at the bond coat-ceramic layer interface, which inhibits further oxidation of the bond coat 24 and substrate 22. Importantly, the diffusion 28 is formed in such a manner that the surface roughness of the bond coat 24 is not altered by the presence of the diffusion 28, which has been a principal obstacle to prior art attempts to improve the oxidation resistance of an APS bond coat with overlay coatings.

Preferred metals for the diffusion 28 include platinum, palladium, hafnium, rhenium and rhodium, with platinum being preferred. The diffusion 28 is formed by applying a thin layer of one or more of the aforementioned metals on the bond coat 24 by a suitable process, such as electroplating, sputtering, PVD, etc. A preferred thickness is about two to about ten micrometers, which enables the metal to be readily diffused into the bond coat 24 at temperatures that will not degrade the bond coat 24 or the properties of the substrate 22. A preferred diffusion treatment entails heating the bond coat 24 in a vacuum to a temperature of about 1000° C. to about 1200° C., preferably about 1050° C. for a duration of about one to about six hours, preferably about two hours. At the completion of this treatment, the thin metal layer is completely diffused into the bond coat 24 (i.e., the originally applied metal does not remain on the surface of the bond coat 24), and may extend completely through the bond coat 24 and into the substrate 22. Importantly, the surface roughness of the bond coat 24 is not altered by the diffusion 28, but instead is preserved so as to remain within the desired 200 to 500 μinch Ra range. The thickness of the bond coat 24 is preferably about 50 to about 200 micrometers. Thereafter, the ceramic layer 26 is deposited by an appropriate APS technique known in the art.

In the course of evaluating this invention, thermal cycle testing was performed at temperatures of about 1090° C. (about 2000° F.) and about 980° C. (about 1800° F.) on nickel-base superalloy specimens having APS ceramic layers deposited on APS NiCrAlY bond coats, some of which were modified with a platinum diffusion in accordance with this invention. The specimens processed in accordance with this invention exhibited a significantly improved thermal cycle durability—generally about two-times greater than that of those specimens processed in accordance with the prior art.

While our invention has been described in terms of a preferred embodiment, it is apparent that other forms could be adopted by one skilled in the art. Accordingly, the scope of our invention is to be limited only by the following claims.

What is claimed is:

1. A process for forming a thermal barrier coating system on a surface of a superalloy component, the method comprising the steps of:

depositing a bond coat on the surface by air plasma spraying such that the bond coat has a surface roughness of about 200 to about 500 $\mu$inch Ra;

depositing a metal on the bond coat and then completely diffusing the metal into the bond coat and, optionally, also into the surface of the superalloy component, so as not to alter the surface roughness of the bond coat, the metal being chosen from the group consisting of platinum, palladium, hafnium, rhenium and rhodium; and air plasma spraying a ceramic layer on the bond coat having the metal diffused therein.

2. A process as recited in claim 1, wherein the metal is platinum and is completely diffused through the bond coat and into the surface of the superalloy component.

3. A process as recited in claim 1, wherein the metal is deposited to a thickness of about two to about five micrometers prior to being diffused into the bond coat.

4. A process as recited in claim 1, wherein the bond coat is MCrAlY, where M is iron, cobalt and/or nickel.

5. A process as recited in claim 1, wherein a continuous oxide layer is not present on the bond coat during the step of depositing and diffusing the metal into the bond coat.

* * * * *